United States Patent [19]

Hara et al.

[11] Patent Number: 4,956,987

[45] Date of Patent: Sep. 18, 1990

[54] ROTARY CUTTER FOR CUTTING A CONTINUOUS CORRUGATED STRIP

[75] Inventors: Yoshihiro Hara, Nagoya; Takatoshi Iwase, Anjo, both of Japan

[73] Assignee: Nippondenso Co., Ltd., Kariya, Japan

[21] Appl. No.: 384,483

[22] Filed: Jul. 25, 1989

[30] Foreign Application Priority Data

Jul. 27, 1988 [JP] Japan ..... 63-187168

[51] Int. Cl.[5] ..... B21D 13/04

[52] U.S. Cl. ..... 72/185; 72/194; 72/331; 83/303; 83/304; 83/337

[58] Field of Search ..... 72/185, 186, 194, 331; 83/287, 303, 304, 337

[56] References Cited

U.S. PATENT DOCUMENTS

| | | | |
|---|---|---|---|
| 2,405,204 | 8/1946 | Goodrich | 83/337 |
| 2,951,410 | 9/1960 | Brown | 83/304 |
| 3,071,175 | 1/1963 | Karkoska | 72/331 |
| 3,460,228 | 8/1969 | Turner | 83/303 |
| 4,685,318 | 8/1987 | Ueda et al. | 72/185 |

FOREIGN PATENT DOCUMENTS

| | | | |
|---|---|---|---|
| 60-48212 | 3/1985 | Japan . | |
| 61-117008 | 6/1986 | Japan . | |
| 61-260907 | 11/1986 | Japan . | |
| 121009 | 3/1957 | U.S.S.R. | 72/185 |
| 678029 | 8/1952 | United Kingdom | 83/337 |

*Primary Examiner*—Robert L. Spruill

*Attorney, Agent, or Firm*—Cushman, Darby & Cushman

[57] ABSTRACT

A high speed rotary cutter includes a toothed counterwheel which has plural radial slots extending in the axial directions. First cutting blades are slidably received in the radial slots, each of which has a first cutting edge on its outer end. The first cutting edge is inclined to the line which is perpendicular to the advancing direction of the continuous corrugated strip. The movement of the first cutting blade between a projected and restored position thereof is controlled by a fixed cam which is located inside of the toothed counterwheel. The rotary cutter also includes a second cutting blade which has a second cutting edge on its outer end and is aligned to the first cutting blade so that the continuous corrugated strip is sheared at the crossing point of the first and second cutting blades. The first and the second cutting blades are biased to be engaged with each other for cutting the fin. The crossing point of the first and second cutting edges moves to the rotation of the toothed counterwheel, so that the continuous corrugated strip is sheared at whole width.

6 Claims, 6 Drawing Sheets

ROTARY CUTTER FOR CUTTING A CONTINUOUS CORRUGATED STRIP

BACKGROUND OF THE INVENTION

1. Field of the Invention

The present invention relates to a rotary cutter for cutting a continuous corrugated strip into strip sections having variable lengths. More particularly, this invention is applicable to a rotary cutter for shearing a metallic corrugated strip into sections which are used as corrugated fins in the manufacture of automobile radiators.

2. Description of the Related Art

Certain types of automotive radiator cores include corrugated fins welded or soldered to water tubes. Corrugated fins are obtained by passing a continuous metallic strip between a pair of toothed forming rollers or wheels to form a continuous corrugated strip, which is then sheared by a cutting machine into sections having a desired length. For the manufacture of radiators on a mass production basis, it is desirable for a cutting machine to operate at as high a speed as possible to shear a corrugated strip discharged continuously and at a high speed from the forming rollers. Another requirement for cutting machines is the capability of shearing the corrugated strip into a desired length, which may vary depending upon the size of the radiator cores to be manufactured. A further requirement is to cut the corrugated strip precisely at a desired shearing point in order to obtain a series of strip sections having a uniform length.

U.S. Pat. No. 4,685,318 issued to Ueda et al. illustrates an example of a conventional cutting apparatus. This type of apparatus is called a rotary cutter and has a toothed wheel and a rotary drum which are rotated in synchronization with each other. A fixed cutter blade is disposed in the toothed wheel and a movable cutter blade is disposed in the rotary drum. The continuous corrugated fin passes between the toothed wheel and rotary drum and is sheared in a predetermined length by pushing the movable cutter blade toward the fixed cutter blade like a guillotine.

In this conventional apparatus, it is required that both cutter blades be shaped and assembled accurately because both cutter blades are engaged at one point on which the outer circles of the toothed wheel and the rotary drum are in contact with each other. Therefore, production costs of the conventional apparatus are high. Another problem is that the edges of the cutter blades are worn away in a short period because each edge of the cutter blades is engaged with the other at a high speed. The worn edge causes the cutting condition of the cutters to worsen. The further problem is that the guillotine type cutter is capable of cutting corrugated fins made of low-ductility materials such as aluminum but is not capable of cutting fins made of high-ductility materials such as copper, thin corrugated fins, or wide corrugated fins.

SUMMARY OF THE INVENTION

The present invention overcomes the foregoing disadvantages. According to the present invention, a first cutting blade is disposed reciprocatively in a slot which is formed in a toothed wheel and the second cutting blade reciprocates while facing the first cutting blade.

The first edge of the first cutting blade intersects the second edge of the second cutting blade when they are engaged with each other for cutting a continuous corrugated strip. The intersecting point of the first and the second edges moves transversely from one side to the other side of both cutting blades in accordance with the rotation of the toothed wheel on which the first cutting blade is disposed.

The continuous corrugated strip is conveyed in such a manner that the strip is engaged with the profile of the toothed wheel and that the strip is sheared at the intersecting point of the first edge and the second edge.

The cutting operation is accomplished after the sheared point moves transversely from one side to the other side of the strip.

The continuous corrugated fin is not sheared widthwise at one time by hitting the first cutting blade against the second cutting blade but is sheared gradually from one side to the other side of the fin. Therefore, high accuracy of assembling the first cutting blade and the second is not required and the cost of producing the apparatus is less expensive than that of the conventional apparatus. The continuous corrugated fin is sheared easily even if it is thin or wide and is made of high-ductility material.

Wearing of the edges of both cutting blades of the present invention is kept low compared with the conventional guillotine type cutter because the first edge is prevented from hitting the second edge.

DETAILED DESCRIPTION OF THE PREFERRED EMBODIMENT

The preferred embodiment of a rotary cutter for cutting corrugated fins used in automotive radiators is described hereinbelow.

Figure 1:
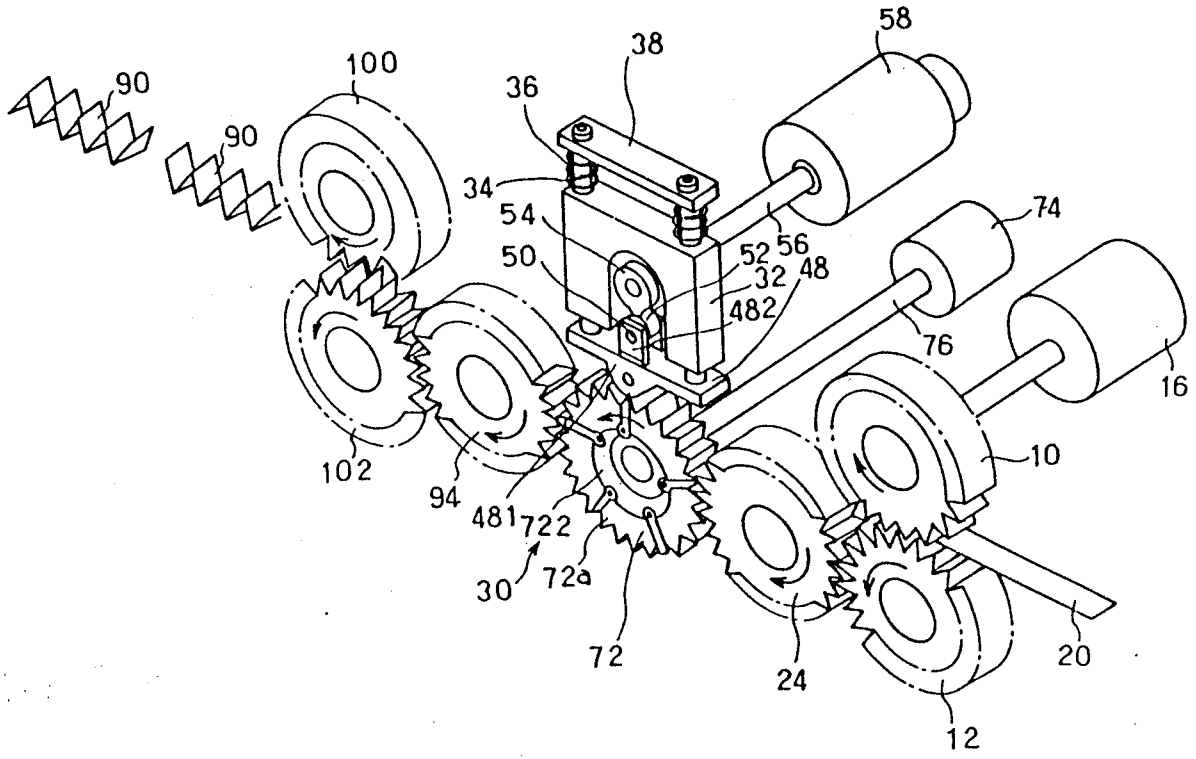
FIG. 1 is a schematic perspective view illustrating the essential parts of a corrugated fin manufacturing apparatus incorporating a rotary cutter according to the present invention as combined with a corrugation forming station.
Figure 2:
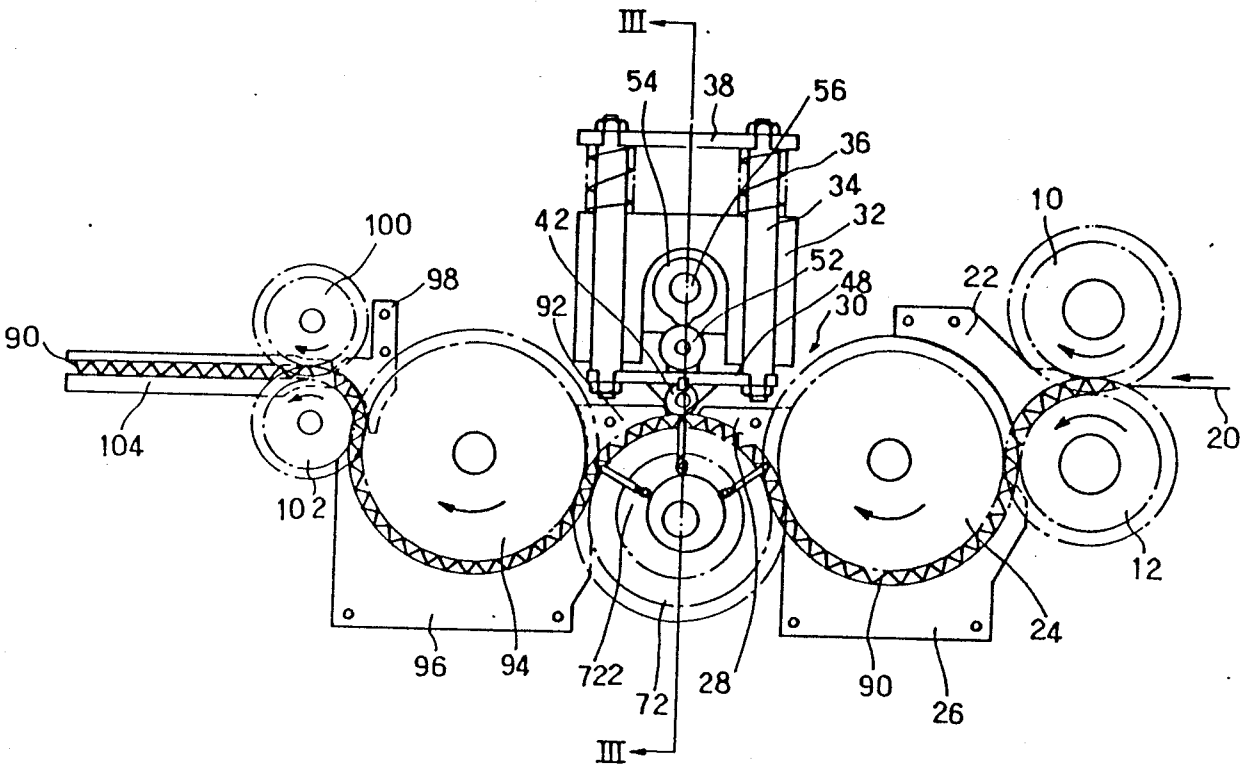
FIG. 2 is a front elevational view of the apparatus shown in FIG. 1.

FIG. 1 is a schematic perspective view showing the essential parts of the corrugated fin manufacturing apparatus including the rotary cutter and FIG. 2 is a front view of the apparatus shown in FIG. 1. A thin flat strip 20 made of copper alloy advances from a source of supply (not shown) through between a pair of toothed forming wheels 10 and 12. A plurality of teeth are formed on the outer surface of the forming wheels 10 and 12. The drive force is given to the forming wheel 10 and transmitted to the forming wheel 12 through a gear wheel mechanism (not shown). The forming wheel 10 and the forming wheel 12 rotate synchronously in engaging with each other. The thin strip 20 advances into the engaging point of the both wheels 10 and 12 so that the strip 20 is formed into a corrugated shape.

The corrugated strip (the corrugated fin), is conveyed to a cutting apparatus 30 by the feed wheel 24. The feed wheel 24 has teeth on the outer surface thereof and rotates synchronously with the forming wheels 10 and 12 by receiving the drive force from AC motor 16 via a gear mechanism.

A guide plate 22 for guiding a corrugated fin 90 passed from the forming wheels 10 and 12 to the feed wheel 24 is disposed between the forming wheels 10 and 12 and the feed wheel 24, and a guide plate 26 for guiding the corrugated fin 90 toward the cutting apparatus 30 is disposed below the feed wheel 24 in order to maintain the engagement of the corrugated fin 90 with the feed wheel 24.

Figure 3:
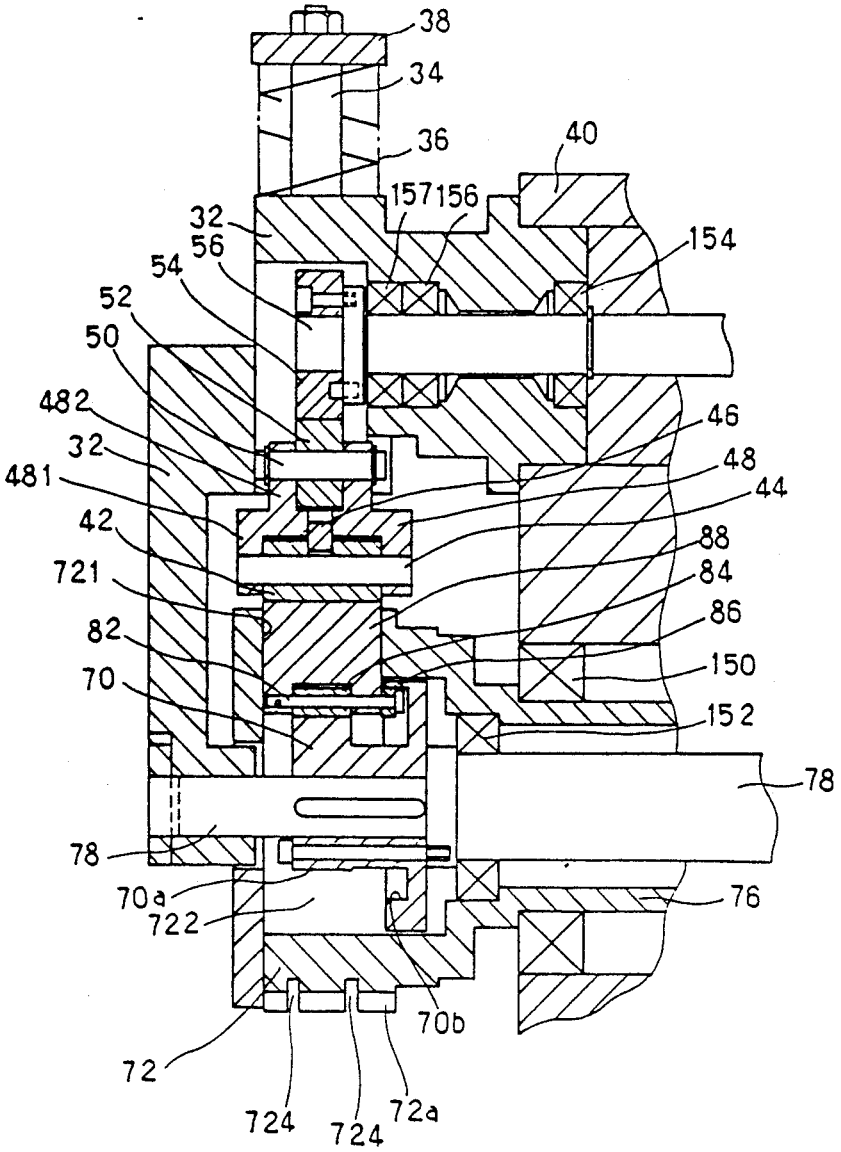
FIG. 3 is a sectional view along line III—III of FIG. 2.
Figure 4:
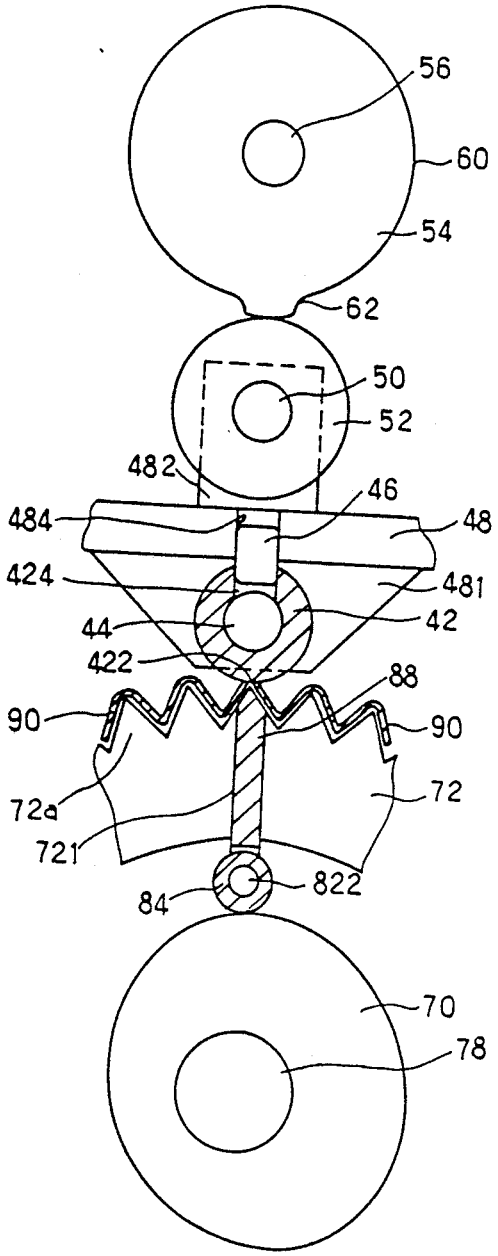
FIG. 4 is a front elevational view illustrating the essential parts of the apparatus shown in FIGS. 1–3.

The cutting apparatus 30 is described in detail hereinbelow. FIG. 3 is a sectional view taken along line III—III line of FIG. 2. FIG. 4 is a front view illustrating the essential parts of the cutting apparatus 30.

A toothed counterwheel 72 has a plurality (twenty five) of tooth portions 72*a* on its outersurface and engages with the feed wheel 24. The toothed counterwheel 72 is supported by a bearing 150 on a frame 40 of the cutting apparatus 30, and receives a driving force from the AC motor 16 through a gear mechanism (not shown). A rotary-encoder 74 is connected with a shaft 76 of the toothed counterwheel 72 for generating pulse signals in accordance with the rotation of the toothed counterwheel 72.

The toothed counterwheel 72 is like a doughnut shape having an inner space therein, and five radial slits 721 are formed in the counterwheel in such a manner that the slits open at the summit of the tooth portion 72*a* at every fifth tooth. Plate shaped first cutting blades 88 reciprocate respectively in the five slits 721. Two guide slits 724 having certain depth for receiving a guide member 96 are formed on the outer surface of the toothed counterwheel 72.

Figure 5:
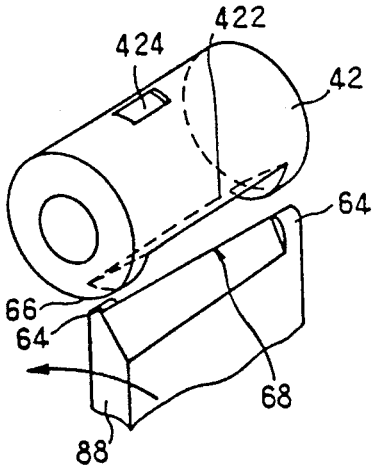
FIG. 5 is an enlarged perspective view of the first cutting blade and the second cutting blade.
Figure 7:
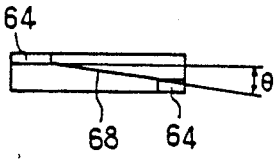
FIG. 7 is a plan view of the first cutting blade.

The first cutting blades 88 have a first cutting edge 68 at the outer edge portion thereof. FIG. 7 is a top plan view of the first cutting blade 88 looking down on the first edge 68. FIG. 5 is a perspective view of the first cutting blade 88 and a second cutting blade 42 (described later). As shown from these figures, the first cutting edge 68 is not at right angles to the advancing direction of the corrugated fin 90, and the same makes a certain angle (2° in this embodiment) against the vertical direction of the advancing direction. Non-cutter portions 64 are formed on both ends on opposite sides of the first cutting edge 68.

The inner side portion of the first cutting blade 88 is shaped like a letter "U" so that a inner space in which a cylindrical roller 84 is provided is formed. The roller 84 is supported at the inside of the first cutting blade 88 by a pin 82 and a cylindrical roller 86 is supported at the outside of the first cutting blade 88 by the pin 82.

A fixed cam 70 is provided in the inner space 722 of the toothed counterwheel 72. The fixed cam 70 reciprocates the first cutting blade 88 between a projecting position when the first cutting edge 68 protrudes from the slit 721 and a retracted position when the first cutting edge 68 returns back into the slit 721. A shaft 78 on which the fixed cam 70 is provided is supported by a bearing 152 which is mounted on the inner surface of the toothed counterwheel 72. The fixed cam 70 and the toothed counterwheel 72 are able to rotate relative to each other. The fixed cam 72 has an outer profile 70*a* and an inner profile 70*b*. The inner roller 84 engages with the outer profile 70*a* for moving the first cutting blade 88 to the projecting position at the predetermined rotating position of the toothed counter wheel 72. The outside roller 86 engages with the inner profile 70*b* for moving the first cutting blade 88 to the retracted position. The predetermined rotating position of the toothed counterwheel 72 for the projecting position of the first cutting blade 88 is varied in accordance with the desired cutting length of the corrugated fin.

The second cutting blade 42 is disposed at the outer side of the toothed counter wheel 72 in such a manner that the second cutting blade 42 shears the corrugated fin 90 in cooperation with the first cutting blade 88 when the first cutting blade 88 comes to the projecting position. The cylindrical second cutting blade 42 has a flat portion on the outersurface thereof as shown in FIG. 5 and the edge of the flat portion forms a second cutting edge 422. The second cutting edge 422 is at right angles to the advancing direction of the corrugated fin 90 and the same forms a certain angle with the first cutting edge 68.

The second cutting blade 42 is supported by a pin 44 which is held between two confronting legs 481 of a cutter holder 48 Two projecting walls 482 confronting each other are formed on the upper surface of the cutter holder 48. The roller 52 is rotatably supported by a pin 50 which is held between the two projecting walls 482. The second cutting blade 42 has a holding hole 424 on the upper surface thereof and the cutter holder 48 has a holding hole 484 coaxially with the hole 424. A square pin 46 is inserted into both of the holding hole 424 and the holding hole 484 for preventing the rotation of the second cutting blade 42.

A rotational cam 54 having a cam-nose 62 is engaged with the roller 52. A shaft 56 of the rotational cam 54 is rotatably supported by bearings 154, 156, 157 mounted on the stay 32, and the shaft 56 is connected with a A.C. servo-motor 58. The rotational cam 54 rotates by receiving the driving force from the A.C. servo-motor 58. The second cutting edge 42 supported on the cutter holder 48 is forced toward the first cutting edge when the cam-nose 62 is engaged with the roller 52. The projecting amount of the cam-nose 62 is so designed that the first cutting edge 68 can confront the second cutting edge 422 with no substantial clearance therebetween.

The first cutting blade 88 and the second cutting blade 42 are assembled to be slightly overlapping for absorbing a structural deformation of the cutting apparatus 30 while the apparatus 30 is in the cutting operation of the corrugated fin 90. If the amount of overlapping is not enough for such deformation, the first cutting edge 68 and the second cutting edge 422 will hit each other and the abrasion of both cutting edges 68 and 422 will be caused. Since the non-cutter portions 64 formed at both sides of the first cutting edge 68 contact cylindrical portions of the second cutting blade 42 formed at the both sides of second cutting edge 422 initially in the cutting operation, both cutting edges 68 and 422 are well prevented from hitting each other.

The arch shaped stay 32 is supported on a frame 40 as shown in FIGS. 1, 2 and 3. The rotational cam 54, the roller 52 and other parts are arranged in the stay 32. Two shafts 34 and 34 are held in the stay 32 in such a manner that both shafts 34 reciprocate vertically. One end of each shaft 34 is connected with the cutter holder 48, and the other end of each shaft 34 is connected with a spring holder 38.

The second cutting blade fixed on the cutter holder 48 is biassed to move apart from the first cutting blade 88 by a spring 36 which is disposed between the spring holder 38 and the upper surface of the stay 32.

Guide members 28 and 92 for guiding the corrugated fin 90 to engage with the teeth 72*a* of the toothed counter wheel 72 are disposed at the outer periphery of the toothed counter wheel 72 and at both sides of the second cutting blade 42.

The corrugated fin 90 sheared in a predetermined length by the cutting apparatus 30 is conveyed toward a shooter 104 by a feed wheel 94 and a pair of feed wheels 100 and 102. The shape of the feed wheel 94 is the same as the shape of the feed wheel 24. A pair of the feed wheels 100 and 102 rotate synchronously to feed the corrugated fin 90. The wave of the corrugated fin 90 which has been slightly deformed in a previous stage is also reshaped while the corrugated fin 90 passes through the wheels 100 and 102. The shooter 104 has a U-shaped groove through which the corrugated fin 90 is conveyed to an assembling stage of a radiator (not shown).

The operation of the manufacturing apparatus is described hereinafter.

The strip 20 fed from the source of supply is advanced through a pair of the toothed counterwheels 10 and 12 so that the shape of waves is applied to the strip 20. The waved strip 20, that is the corrugated fin 90, is advanced by engaging with the under teeth of the feed wheel 24 and the toothed counter wheel 72 of the cutting apparatus 30.

The toothed counter wheel 72 is rotated by receiving the rotary power from the A.C. motor 16 in synchronization with the other wheels. The first cutting blade 88 disposed in the slit 721 is urged to project from the slit 721 by the outer profile 70*a* of the fixed cam 70 when the toothed counter wheel 72 rotates in predetermined times, and the first cutting blade 88 is retracted into the slit 721 by the inner profile 70*b* of the fixed cam 70 until the toothed counter wheel 72 rotates a predetermined number of times as determined by encoder 74.

The rotation of the toothed counter wheel 72 is detected by the rotary encoder 74, and the rotational cam 54 is rotated in synchronized relationship with the toothed counter wheel 72 by an A.C. servo-motor 58 which is controlled by the detected signal of the rotary encoder 74. When the corrugated fin 90 is not required to be sheared, the cam-nose 62 does not contact the outer face of the roller 52 to so that the second cutting blade 42 is prevented from engaging with the first cutting blade 88.

When the corrugated fin 90 needs to be sheared, the speed of the rotation of the rotational cam 54 is accelerated or decelerated in order for the cam-nose 62 to engage with the outer surface of the roller 52, so that the second cutting blade 42 is moved downwardly toward the first cutting blade 88 to be in contact with each other.

Figure 6:
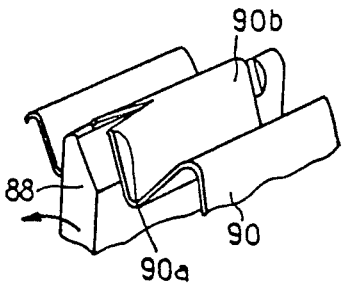
FIG. 6 is an enlarged perspective view illustrating the corrugated fin in a shearing condition.

The first cutting edge 68 contacts with the second cutting edge 42 by keeping substantially no clearance therebetween when the corrugated fin 90 is located at the cross point thereof. Since the first cutting blade 88 is rotated with the toothed counter wheel 72, the cross point of the first cutting edge 68 and the second cutting edge 422 moves from one side of both cutting edges to the other side of the same, and therefore the shearing point also moves from the one side of the corrugated fin 90 to the other side of the same. After that, the shearing of the whole corrugated fin 90 is completed. The second cutting blade 42 is kept in its downward position at least while the cross point of both cutting edges moves from one side to the other side thereof. FIG. 6 shows the condition that the corrugated fin 90 is sheared on the first cutting blade 88. It is recognized that the shearing point moves from the one side 90*a* of the corrugated fin 90 to the other side 90*b* of the same. The sheared corrugated fin as described above is conveyed to the next stage by the feed wheel 94, a pair of the feed wheels 100 and 102 and the shooter 104.

The guide member 96 inserted into the guide slit 724 of the toothed counter wheel 72 guides the corrugated fin 90 for transmitting the same from the toothed counter wheel 72 to the feed wheel 94. The guide member 96 prevents the sheared corrugated fin 90 from failing to be transmitted and also from being engaged with the under teeth of the toothed counter wheel 72.

Even though the guide member 96 is inserted into the guide slit 724 of the toothed counter wheel 72, the guide member 96 and the first cutting blade 88 do not interfere with each other because the first cutting blade 88 is restored into the slit 721 except during the period of the shearing of the corrugated fin 90.

The second embodiment is described hereinbelow.

Figure 8:
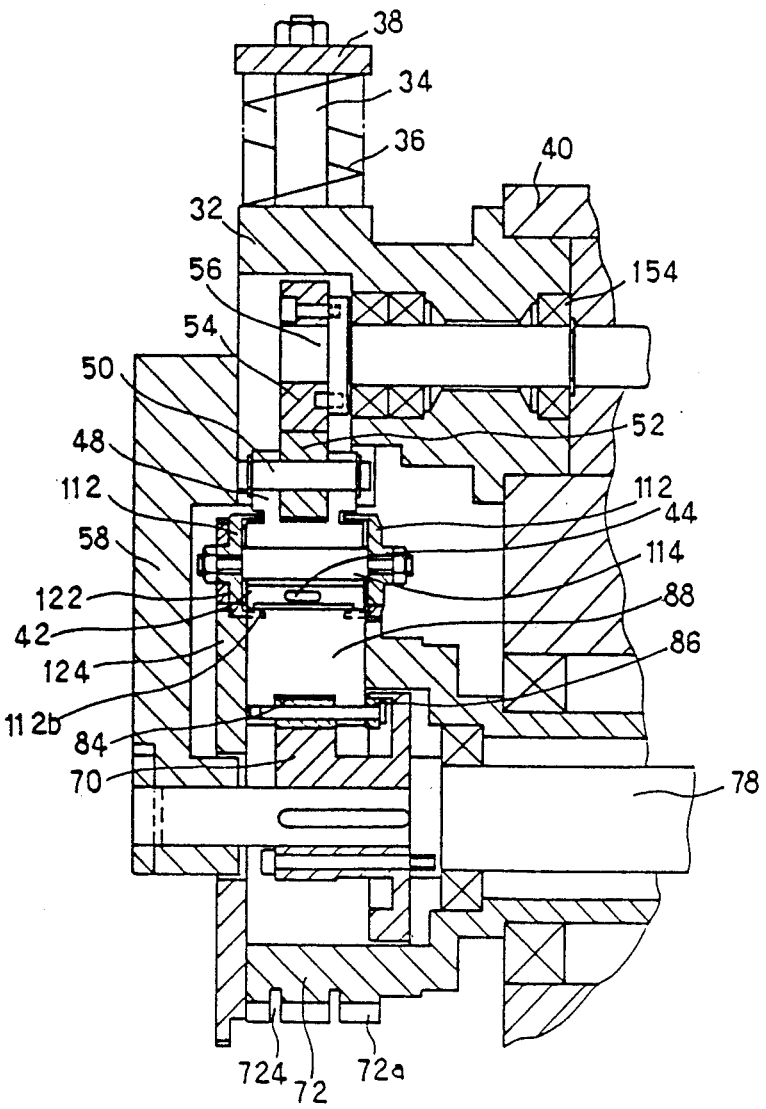
FIG. 8 is a sectional view showing the other embodiment of the invention.

In the second embodiment shown in FIG. 8, the rotary cutter further includes two pin wheels 112 each of which has plural holding pins 112*b* for preventing the sheared edge of the corrugated fin from coming off of the teeth 72*a* of the toothed counter wheel.

Figure 9:
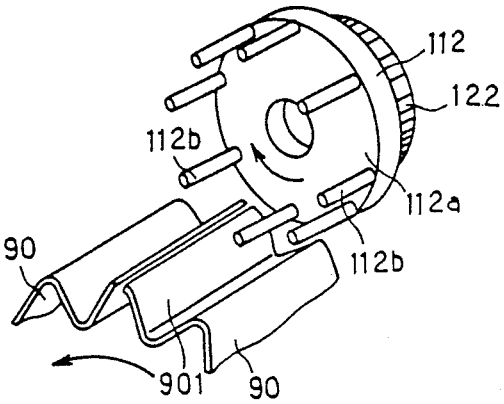
FIG. 9 is an enlarged perspective view illustrating the pin wheel shown in FIG. 8.

As shown in FIG. 9, the pin wheel 112 comprises a disk plate 112*a* and plural holding pins 112*b* which extend from the surface of the disk plate 112*a*, and pin wheels 112 are rotatably supported at both sides of the cutter holder 48 by a pin 114 in such a manner that the holding pins 112*b* hold the corrugated fin 90 prior to being sheared. A small gear 122 connected on the side surface of the disk plate 112*a* by connecting pin 114 is engaged with a large gear 124 fixed on the side surface of the toothed counter wheel 72. The rotating force of the toothed counter wheel 72 is transmitted to the pin wheel 112 through the large gear 124 and the small gear 122, so that the toothed counter wheel 72 and the pin wheel 112 rotate synchronously. The sheared edge 901 of the corrugated fin 90 is held on the tooth 72*a* of the toothed counter wheel 72 during a certain period from just before the corrugated fin 90 is sheared to just after the same is sheared. Therefore, the sheared edge 901 of the corrugated fin 90 is prevented from coming off of the toothed counter wheel 72, and the corrugated fin 90 is well transmitted to the next stage without fail.

The second cutting blade 42 of the second embodiment is a cylinder which has smaller diameter than that of the first embodiment, and the same is fixed on the cutter holder 48 by a key pin 44. The other constructions and operations of the second embodiment are to same as the first embodiment.

While the present invention has been described with reference to specific embodiments thereof, it should be understood that the invention is not limited only to rotary cutters of corrugated fin used for automobile radiators but is applicable also to rotary cutters of continuous corrugated strip used for other heat exchanges.

What is claimed is:

1. A rotary cutter for cutting a continuous corrugated strip comprising:

a frame fixed on a stationary plane;

a toothed counterwheel rotatably supported on the frame and having at least one radial slot extending in the axial direction of the counterwheel;

a rotating means for rotating the toothed counter wheel;

a first cutting blade having a first cutting edge at its outer end slidably received in the radial slot in such a manner that the first cutting blade reciprocates between a retracted position in which the first cutting edge substantially is restored in the radial slot and a projected position in which the first cutting edge is radially outwardly projected from the radial slot;

a first biasing means for biasing the first cutting edge toward the retracted position;

a second biasing means for biasing the first cutting edge toward the projected position;

a second cutting blade having a second cutting edge at its outer end confronting the first cutting edge, the second cutting blade being arranged in such a manner that the second cutting edge is engaged with the first cutting edge when the first cutting blade is in the projected position;

a third biasing means for biasing the second cutting blade toward a cutting position in which the first cutting edge shears the continuous corrugated strip in cooperation with the second cutting edge when the first cutting blade is at the projected position; and at least one of the first cutting edge and the second cutting edge being inclined to a line which is perpendicular to an advancing direction of the continuous corrugated strip at a certain degree so that a cross point of the first cutting edge and the second cutting edge progresses from one side of the continuous corrugated strip to the other side of the continuous corrugated strip, the first cutting blade being positioned at the projected position and the second cutting blade being positioned at the cutting position until said cross point moves across the full width of the first and the second cutting edge.

2. A rotary cutter according to claim 1, further comprising holding pins for holding an end of the continuous corrugated strip sheared by the first cutting edge and the second cutting edge on teeth of the toothed counterwheel in order to convey the sheared continuous corrugated strip along with the toothed counterwheel.

3. A rotary cutter according to claim 1, wherein said first biasing means comprises a fixed cam which is engaged with an inner end of the first cutting blade.

4. A rotary cutter according to claim 1, wherein said second biasing means comprises a rotational cam which is engaged with an inner end of the second cutting blade.

5. A rotary cutter according to claim 1, wherein the rotating means is an electromotor.

6. A rotary cutter according to claim 1, wherein the toothed counterwheel has a guide slit having a certain depth on outer periphery thereof, and further comprising a guide member being engaged with the guide slit for guiding the continuous corrugated strip sheared by the first and the second cutting blade.

* * * * *